United States Patent [19]

Yoshida et al.

[11] Patent Number: 4,627,552

[45] Date of Patent: Dec. 9, 1986

[54] FUEL SUPPLYING APPARATUS

[75] Inventors: Takeomi Yoshida, Fujisawa; Kazuhisa Yamashita, Kawasaki; Yukio Miura, Fujisawa, all of Japan

[73] Assignee: Tokico Ltd., Kanagawa, Japan

[21] Appl. No.: 663,034

[22] Filed: Oct. 19, 1984

[30] Foreign Application Priority Data

Oct. 20, 1983 [JP] Japan ..... 58-162427[U]

[51] Int. Cl.[4] ..... B67D 5/10

[52] U.S. Cl. ..... 222/14; 222/63; 364/479

[58] Field of Search ..... 222/14, 22, 15–20, 222/63; 364/479; 377/21

[56] References Cited

U.S. PATENT DOCUMENTS

| | | | |
|---|---|---|---|
| 2,065,052 | 12/1936 | Carroll | 222/22 |
| 2,656,068 | 10/1953 | Soar | 222/22 |
| 3,598,283 | 8/1971 | Krutz et al. | 222/14 |
| 3,773,219 | 11/1973 | Irie et al. | 222/14 X |
| 4,522,237 | 6/1985 | Endo et al. | 222/14 X |

FOREIGN PATENT DOCUMENTS

| | | | |
|---|---|---|---|
| 686464 | 5/1964 | Canada | 222/14 |
| 859283 | 8/1981 | U.S.S.R. | 222/14 |

*Primary Examiner*—Joseph J. Rolla
*Assistant Examiner*—Frederick R. Handren
*Attorney, Agent, or Firm*—Michael N. Meller

[57] ABSTRACT

A fuel supplying apparatus comprises a first circuit for measuring a flow quantity of fuel which passes through a fuel supplying hose, a single mode setting switch provided on the hose at a position in a vicinity of a nozzle, a second circuit for discriminating the state of the apparatus based on the existence of an output of the first circuit, and a third circuit for controlling the supply of fuel. The second circuit discriminates that the apparatus is set to a preset quantity supplying mode when the switch is manipulated in a state before a fuel supplying operation is started, and discriminates that the apparatus is set to an integral quantity supplying mode when the switch is manipulated in a state during the fuel supplying operation. The third circuit performs a control so that a fuel supplying quantity is preset responsive to a manipulation of the switch and a fuel supplying operation is performed with respect to the preset quantity when the apparatus is set to the preset quantity supplying mode, and an operation of supplying a minimum integral quantity of fuel which is greater than a quantity of supplied fuel at a point when the switch is manipulated is performed when the apparatus is set to the integral quantity supplying mode.

6 Claims, 8 Drawing Figures

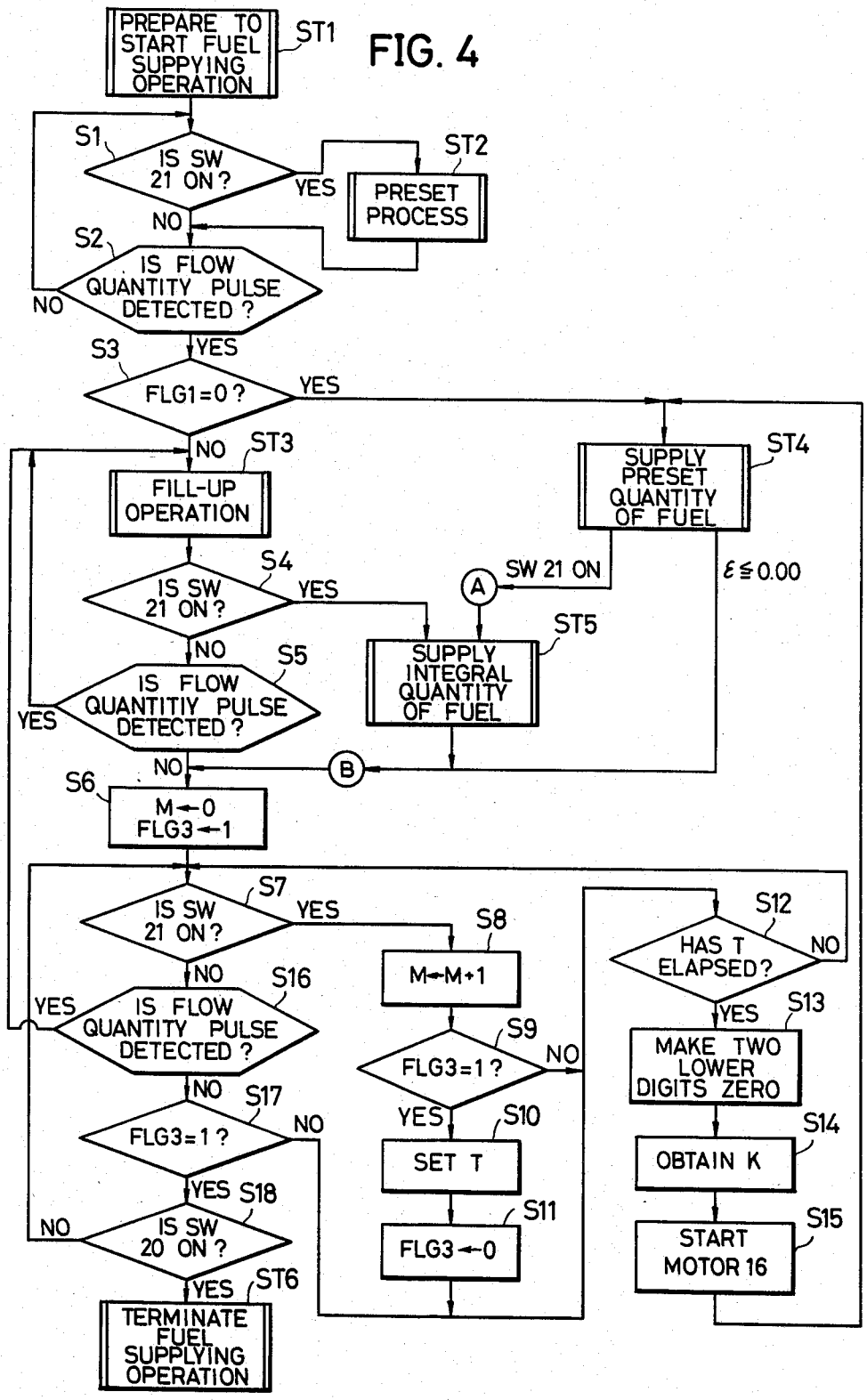
PREPARE TO START FUEL SUPPYING OPERATION
ST1
FIG. 4
S1
IS SW 21 ON ?
YES
ST2
PRESET PROCESS
NO
S2
IS FLOW QUANTITY PULSE DETECTED ?
NO
YES
S3
FLG1=0 ?
YES
NO
ST3
FILL-UP OPERATION
SUPPLY PRESET QUANTITY OF FUEL
ST4
S4
IS SW 21 ON ?
YES
SW 21 ON
A
ε≦0.00
ST5
SUPPLY INTEGRAL QUANTITY OF FUEL
NO
S5
IS FLOW QUANTITIY PULSE DETECTED ?
YES
NO
B
S6
M←0
FLG3←1
S7
IS SW 21 ON ?
YES
S8
M←M+1
NO
S16
IS FLOW QUANTITY PULSE DETECTED ?
YES
S9
FLG3=1 ?
NO
NO
S17
FLG3=1 ?
NO
YES
S10
SET T
YES
S18
IS SW 20 ON ?
NO
S11
FLG3←0
YES
ST6
TERMINATE FUEL SUPPLYING OPERATION
S12
HAS T ELAPSED?
NO
YES
S13
MAKE TWO LOWER DIGITS ZERO
S14
OBTAIN K
S15
START MOTOR 16

FUEL SUPPLYING APPARATUS

BACKGROUND OF THE INVENTION

The present invention generally relates to fuel supplying apparatuses, and more particularly to a fuel supplying apparatus which has a single fuel supplying mode setting switch provided in a vicinity of a fuel supplying nozzle which is provided on a tip end of a fuel supplying hose. The fuel supplying apparatus according to the present invention is designed to selectively perform a fuel supplying operation in one mode from among a preset quantity supplying mode in which a preset quantity of fuel is supplied, an integral quantity supplying mode in which the supply of fuel is always stopped at an integral quantity when an operation is performed to stop the fuel supply during the fuel supplying operation, and an additional integral quantity supplying mode in which the quantity of supplied fuel is corrected to an integral quantity, responsive to a manipulation of the single mode setting switch.

Generally, modes of fuel supplying operations which are performed by a fuel supplying apparatus, may be roughly divided into the following three modes.

(i) A fill-up mode in which the fuel is supplied until a tank of a vehicle becomes full;

(ii) A preset quantity supplying mode in which a fuel supplying quantity is preset before the fuel supplying operation is started, and the fuel is supplied until the preset quantity is reached; and (iii) An integral quantity supplying mode in which the supply of fuel is always stopped at an integral quantity when an operation is performed to stop the fuel supply during the fuel supplying operation. When a switch is manipulated to stop the fuel supply during the above preset quantity supplying mode (ii) of the fuel supplying apparatus, the supply of fuel is stopped when the quantity of supplied fuel reaches an integral quantity which is greater than and is closest to the quantity of supplied fuel at the point when the switch is manipulated.

A fuel supplying nozzle of a conventional fuel supplying apparatus is generally provided with a mechanism for automatically stopping the supply of fuel when it is detected that the tank of the vehicle is full. For this reason, it is unnecessary to provide a special switch for setting the fuel supplying apparatus to the fill-up mode (i) described before. However, switches must be provided in order to set the fuel supplying apparatus to the modes (ii) and (iii) described before.

On the other hand, there is the so-called hanging type fuel supplying apparatus in which a fuel supplying hose having the fuel supplying nozzle provided on the tip end thereof, is provided in a hanging manner from a delivery unit which is located at a high position such as a ceiling of a fuel supplying station. In such a hanging type fuel supplying apparatus, switches are provided in a vicinity of the fuel supplying nozzle, so that the operator may easily manipulate these switches. Hence, in the conventional hanging type fuel supplying apparatus which is designed to operate in the modes (i) through (iii) described before, a total of three switches are provided in the vicinity of the fuel supplying nozzle. In other words, two switches are provided for setting the fuel supplying apparatus to the modes (ii) and (iii), in addition to an elevator switch for raising and lowering the fuel supplying nozzle. Generally, the elevator switch comprises a push button switch for raising the fuel supplying nozzle, and a pull switch for lowering the fuel supplying nozzle. The pull switch is pulled when the operator pulls on a string which is connected to the pull switch.

Accordingly, a large number of switches are provided in the conventional fuel supplying apparatus. Thus, the construction of a switch box which accommodates the switches which are provided in the vicinity of the fuel supplying nozzle, is complex. Further, a flowing path for the fuel within the fuel supplying hose is narrow, because a large number of signal lines originate from the switches. Moreover, it is not easy to manipulate the fuel supplying nozzle since the switch box is bulky. When the switch box is to be downsized, the switches must be arranged close to each other, but this will increase the possibility of erroneous manipulation of the switches, such as an erroneous manipulation of a switch adjacent to a switch which is actually to be manipulated. The possibility of such an erroneous manipulation of the switches increases as the number of switches increases. In addition, when further increasing the modes of fuel supplying operations which are to be performed by the fuel supplying apparatus, it is necessary to increase a corresponding number of switches, and the problems described above become even more notable.

SUMMARY OF THE INVENTION

Accordingly, it is a general object of the present invention to provide a novel and useful fuel supplying apparatus in which the problems described heretofore are eliminated.

Another and more specific object of the present invention is to provide a fuel supplying apparatus which is selectively set to a preset quantity supplying mode or an integral quantity supplying mode so as to perform a fuel supplying operation in the set mode, responsive to a manipulation of a single mode setting switch, depending on the state of the fuel supplying operation at a point when the single mode setting switch is manipulated. According to the apparatus of the present invention, the fuel supplying apparatus can be set to one of the above modes by manipulating the single mode setting switch, and the number of switches which must be provided in the vicinity of a fuel supplying nozzle can be kept down to a minimum. Hence, the number of signal sources along a fuel supplying hose can be kept down to a minimum. As a result, the construction of the fuel supplying apparatus especially in the vicinity of the fuel supplying nozzle is simple, and the fuel supplying nozzle can be manipulated with ease. Further, it is possible to enlarge a flowing path for the fuel within the fuel supplying hose, and it is possible to prevent erroneous manipulation of switches.

Still another object of the present invention is to provide a fuel supplying apparatus which can further be set to an additional integral quantity supplying mode so as to perform a fuel supplying operation in the set mode, responsive to a manipulation of the single mode setting switch, depending on the state of the fuel supplying operation at a point when the single mode setting switch is manipulated.

A further object of the present invention is to provide a fuel supplying apparatus which comprises a single mode setting switch provided in a vicinity of a fuel supplying nozzle, and a mode discriminating means for discriminating whether the fuel supplying apparatus is in a state before a fuel supplying operation is started, a state during the fuel supplying operation, or a state after the fuel supplying operation is terminated, based on a flow quantity pulse signal. The mode discriminating means discriminates that the fuel supplying apparatus is set to a preset quantity supplying mode when the single mode setting switch is manipulated before the fuel supplying operation is started, an integral quantity supplying mode when the single mode setting switch is manipulated during the fuel supplying operation, and an additional integral quantity supplying mode when the single mode setting switch is manipulated immediately after the fuel supplying operation is terminated. According to the apparatus of the present invention, the fuel supplying apparatus can be set to any one of the above three modes by manipulating the single mode setting switch.

Other objects and further features of the present invention will be apparent from the following detailed description when read in conjunction with the accompanying drawings.

BRIEF DESCRIPTION OF THE DRAWINGS

FIGS. 4, 5A, 5B, 6, and 7 are flow charts for explaining operations of the control systems shown in FIGS. 2 and 3.

DETAILED DESCRIPTION

Figure 1:
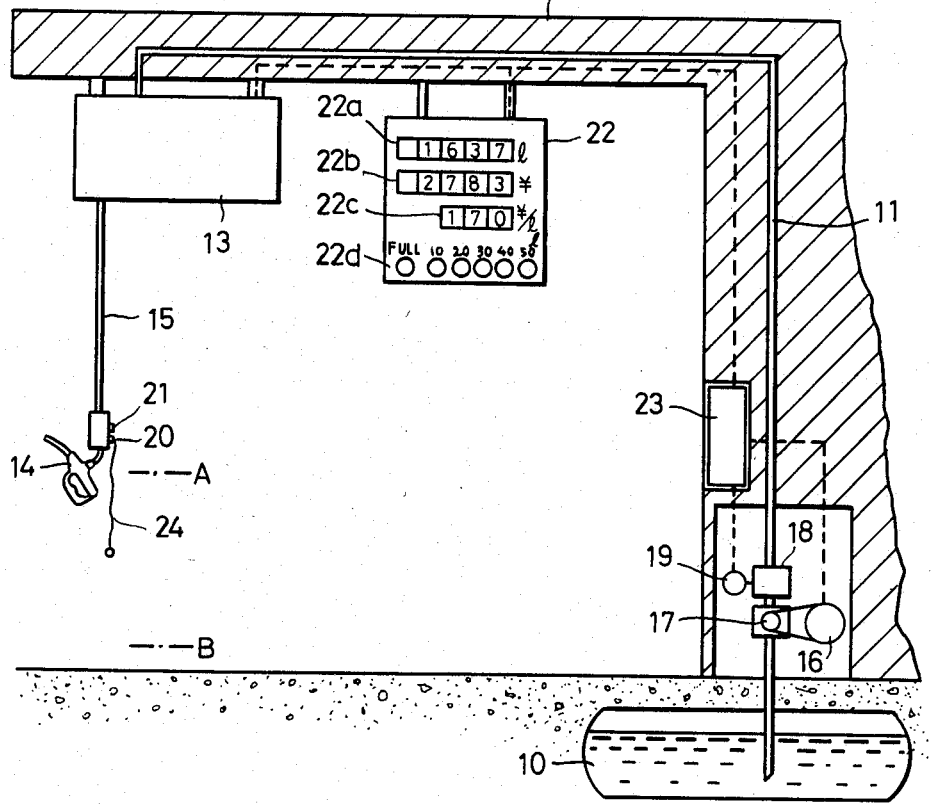
FIG. 1 is a partial cross sectional view showing the construction of an embodiment of a fuel supplying apparatus according to the present invention.

FIG. 1 shows an embodiment of the present invention applied to a hanging type fuel supplying apparatus. In FIG. 1, one end of a pipe arrangement 11 communicates with an underground tank 10 which stores the fuel. The other end of the pipe arrangement 11 communicates with a fuel supplying hose 15 which has a fuel supplying nozzle 14 provided at a tip end thereof, through a delivery unit 13 which is provided in a structure 12 located at a high part of the fuel supplying station. A pump 17 which is driven by a pump driving motor 16, and a flowmeter 18 for measuring the fuel supplying quantity, are provided in the pipe arrangement 11. The flowmeter 18 comprises a flow quantity pulse generator 19 which generates a flow quantity pulse signal proportional to the flow quantity of the fuel which is measured.

An elevator switch 20 and a single mode setting switch 21 are located on the fuel supplying hose 15, in the vicinity of the fuel supplying nozzle 14. The elevator switch 20 drives a hose elevator driving mechanism (not shown) within the delivery unit 13, and raises and lowers the fuel supplying nozzle 14 between a waiting position A where the fuel supplying nozzle 14 does not interfere with a vehicle (not shown) which enters and leaves the fuel supplying station, and a fuel supplying position B which is suited for performing the fuel supplying operation with respect to the vehicle. As in the conventional fuel supplying apparatus, the elevator switch 20 comprises a push button switch which is pushed when raising the fuel supplying nozzle 14, and a pull string 24 which is pulled when lowering the fuel supplying nozzle 14. The single mode setting switch 20 sets the fuel supplying mode, as will be described later on in the specification.

An indicator unit 22 is located within the fuel supplying station, at a position where it is easily visible by the operator. The indicator unit 22 comprises an indicator **22*a* for displaying the quantity of supplied fuel, an indicator 22*b* for displaying the price of supplied fuel, an indicator 22*c* for displaying the unit price of fuel, and indicator lamps 22*d* for displaying a preset quantity (for example, FULL, 10 liters, 20 liters, 30 liters, 40 liters, and 50 liters). A control device 23** is located at a non-dangerous part within the fuel supplying station.

Figure 2:
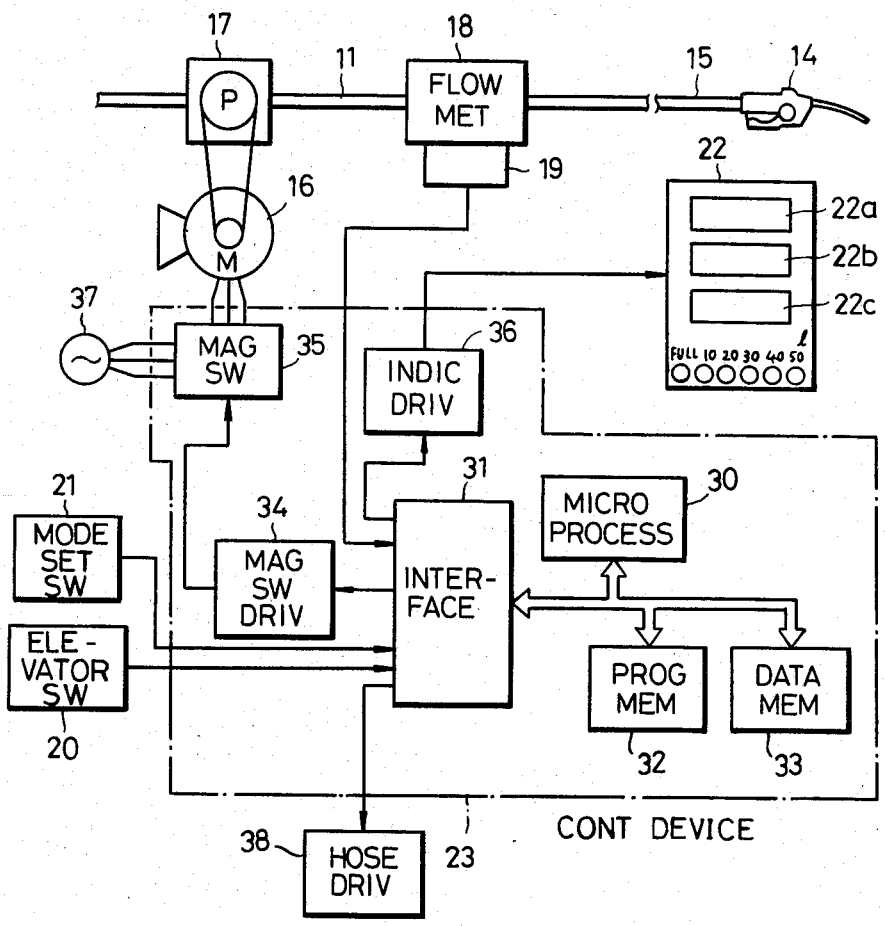
FIG. 2 is a systematic block diagram showing a control system of the apparatus shown in FIG. 1.

Next, description will be given with respect to the system constitution of the fuel supplying apparatus shown in FIG. 1, by referring to FIG. 2. In FIG. 2, those parts which are the same as those corresponding parts in FIG. 1 are designated by the same reference numerals, and their description will be omitted.

The control device 23 comprises a microprocessor 30, an interface 31, a program memory 32, a data memory 33, a magnetic switch driving circuit 34, a magnetic switch 35, and an indicator driving circuit 36. A hose elevator driving mechanism 38 is located within the delivery unit 13.

According to the control instructions which are pre-stored in the program memory 32, the microprocessor 30 reads in a manipulation signal from the elevator switch 20 through the interface 31, and drives and controls the hose elevator driving mechanism 38 to raise and lower the fuel supplying nozzle 14. In addition, responsive to the manipulation of the elevator switch 20 and the drive and stoppage of the hose elevator driving mechanism 38, the microprocessor 30 carries out operations such as driving and stopping the motor 16, and resetting the indicators **22*a* and 22*b* of the indicator unit 22 to zero. Moreover, the microprocessor 30 counts the flow quantity pulses of the flow quantity pulse signal which is received from the flow quantity pulse generator 19 through the interface 31, and calculates a quantity Q of fuel which has been supplied and the price of fuel which has been supplied. The calculated quantity Q of fuel which has been supplied and the calculated price of fuel which has been supplied are supplied to the indicator driving circuit 36 through the interface 31, and the calculated quantity Q of fuel which has been supplied and the price of fuel which has been supplied are respectively displayed on the indicators 22*a* and 22*b***.

Figure 3:
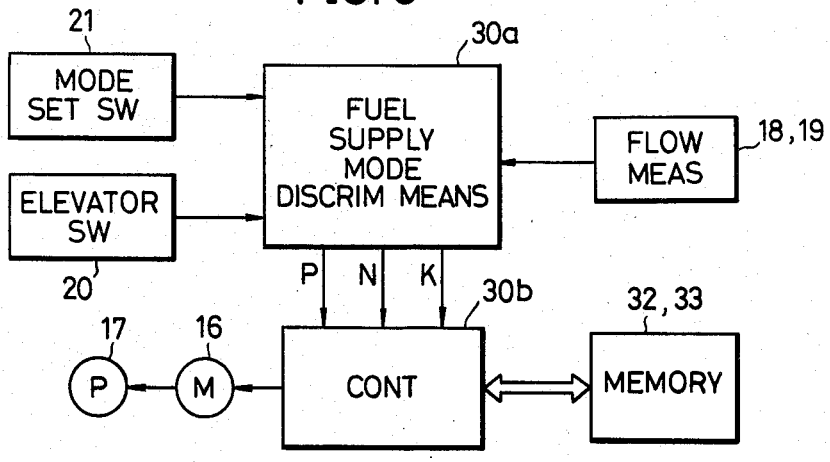
FIG. 3 is a systematic block diagram for explaining general functions of the control system shown in FIG. 2.
Figure 5A:
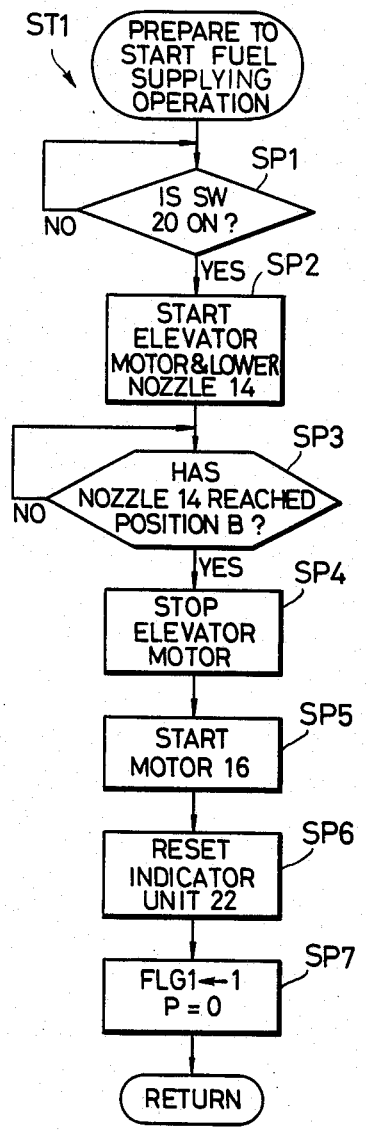
Figure 5B:
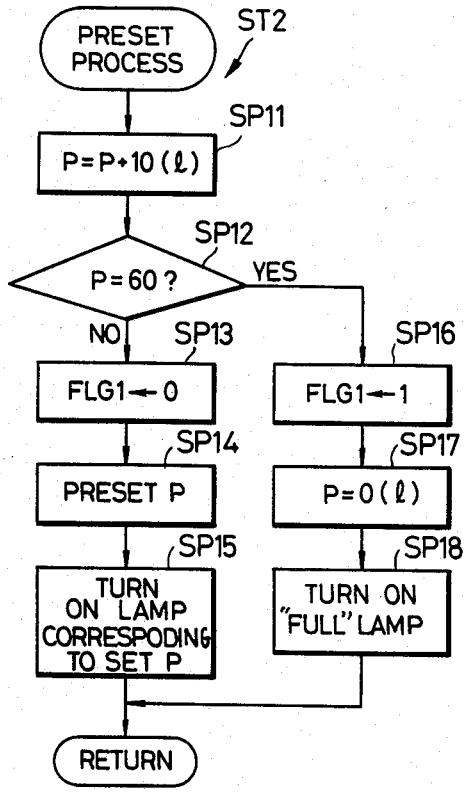
Figure 6:
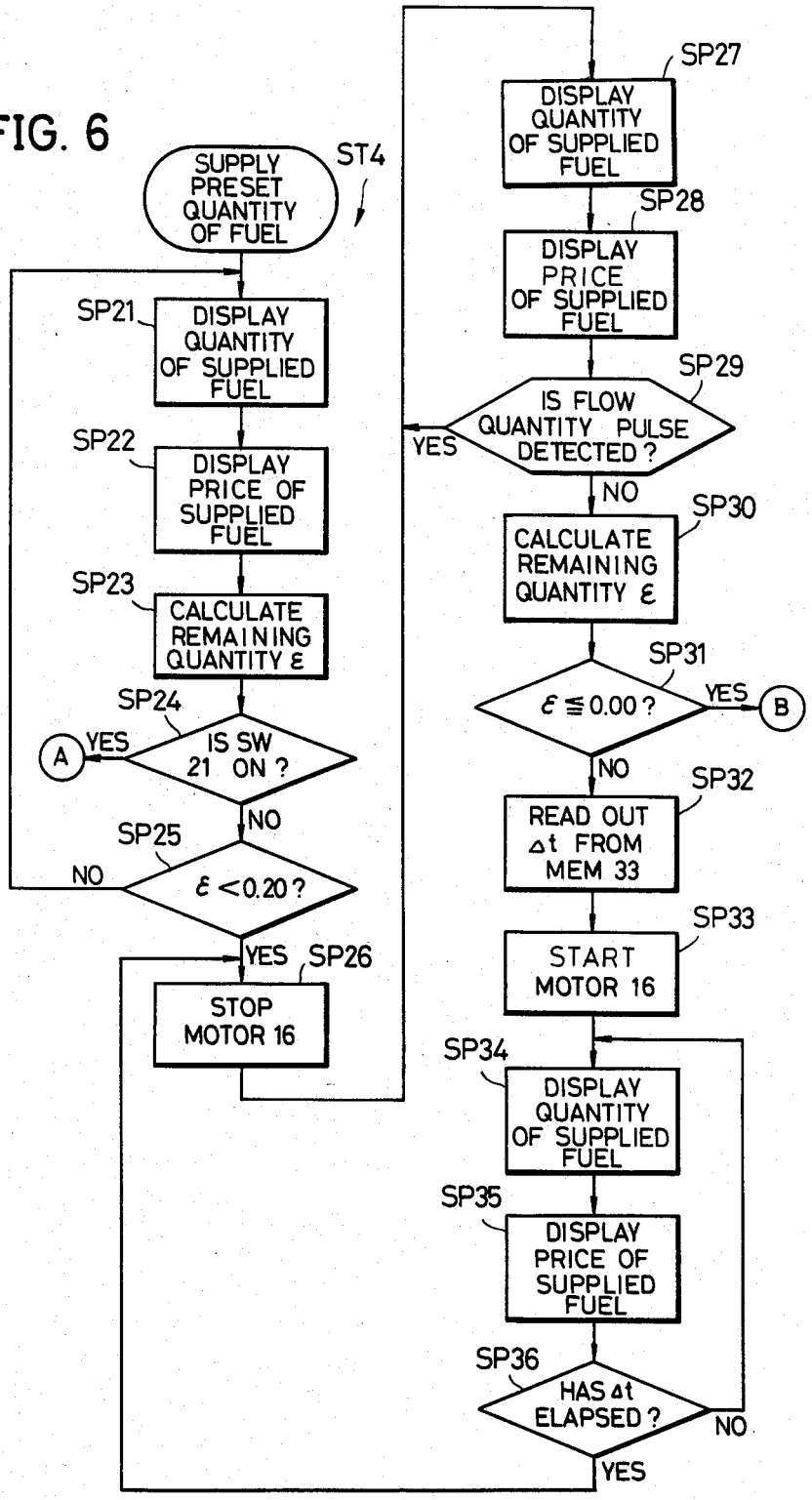

Further, according to the control instructions which are pre-stored in the program memory 32, the microprocessor 30 also functions as fuel supplying mode discriminating means **30*a* shown in FIG. 3. In other words, the microprocessor 30 discriminates that the fuel supplying apparatus is in a state (a) before the fuel supplying operation is started, during an interval from a time when the pull string 24 of the elevator switch 20 is pulled so as to lower the fuel supplying nozzle 14 from the waiting position A up to a time when a valve in the fuel supplying nozzle 14 is opened so as to start the fuel supply and the flow quantity measuring means 18 and 19 shown in FIG. 3 generates the flow quantity pulse signal. The microprocessor 30 discriminates that the fuel supplying apparatus is in a fuel supplying state (b) during an interval from a time when the above fuel supply is started up to a time when the valve of the fuel supplying nozzle 14 is closed so as to stop the fuel supply and the flow quantity measuring means 18 and 19 no longer generates the flow quantity pulse signal. Further, the microprocessor 30 discriminates that the fuel supplying apparatus is in a state (c) after the fuel supplying operation is terminated, during an interval from a time when the above fuel supply is stopped and the flow quantity measuring means 18 and 19 no longer generates the flow quantity pulse signal up to a time when the fuel supplying nozzle 14 is returned to the waiting position A. In addition, the microprocessor 30 discriminates that the fuel supplying apparatus is set to a preset quantity supplying mode (A) when the mode setting switch 21 is manipulated during the state (a) before the fuel supplying operation is started. The microprocessor 30 discriminates that the fuel supplying apparatus is set to an integral quantity supplying mode (B) when the mode setting switch 21 is manipulated during the fuel supplying state (b). The microprocessor 30 discriminates that the fuel supplying apparatus is set to an additional integral quantity supplying mode (C) when the mode setting switch 21 is manipulated during the state (c) after the fuel supplying operation is terminated. The discrimination result in the microprocessor 30 with regard to the fuel supplying mode is supplied to control means 30***b*.

The microprocessor 30 also functions as the control means 30*b*. In other words, the microprocessor 30 discriminates whether the fuel supplying apparatus is set to a fill-up mode, the preset quantity supplying mode, the integral quantity supplying mode, or the additional integral quantity supplying mode, and controls and drives the pump 17 depending on the discriminated fuel supplying mode. The microprocessor 30 controls and drives the pump 17 until the flow quantity pulse signal is no longer generated, when the fill-up mode is discriminated. The microprocessor 30 controls and drives the pump 17 until the supplied quantity of fuel reaches the preset quantity, when the preset quantity supplying mode is discriminated. The microprocessor 30 controls and drives the pump 17 until the supplied quantity of fuel reaches the set integral quantity, when the integral quantity supplying mode is discriminated. Furthermore, the microprocessor 30 controls and drives the pump 17 until the supplied quantity of fuel reaches a preset additional integral quantity, when the additional integral quantity supplying mode is discriminated.

A method of accurately controlling the fuel supply so that the quantity of supplied fuel becomes equal to the preset quantity during the preset quantity supplying mode and equal to the set integral quantity during the integral quantity supplying mode is disclosed in U.S. patent application Ser. No. 600,004 entitled "CONTROL SYSTEM FOR CONTROLLING THE SUPPLY OF A PREDETERMINED QUANTITY OF FLUID" and filed Apr. 13, 1984, in which the assignee is the same as the assignee of the present application. Hence, the above method will not be described in detail, but the method disclosed in the U.S. patent application Ser. No. 600,004 generally works as follows. That is, when the quantity of supplied fuel reaches a quantity which is slightly less than a target quantity, the driving of the pump 17 is once stopped. Then, the pump 17 is driven for a minimum driving time $\Delta t(=f(\epsilon)$ and $\Delta t$ is a function of a remaining quantity $\epsilon$) which is preset (and stored in the data memory 33) according to the remaining quantity $\epsilon$(=target quantity minus quantity of supplied fuel), and is stopped. Next, a new remaining quantity $\epsilon$ is obtained, and the pump 17 is driven for a minimum driving time $\Delta t$ which is determined according to the new remaining quantity $\epsilon$, and is stopped. Such operations are repeated, and the remaining quantity $\epsilon$ is gradually made equal to zero while gradually decreasing the minimum driving time $\Delta t$ according to the remaining quantity $\epsilon$.

Next, description will be given with respect to the control systems shown in FIGS. 2 and 3 and the operation of the microprocessor 30 in particular, by referring to the flow charts shown in FIGS. 4 through 7. The fuel supplying apparatus is set to different fuel supplying modes when the mode setting switch 21 is manipulated, depending on whether the fuel supplying apparatus is in the state before the fuel supplying operation is started, in the state during the fuel supplying operation, or in the state after the fuel supplying operation is terminated. Hence, description will be given hereinafter with respect to each case.

(1) When the fuel supplying apparatus is in the state before the fuel supplying operation is started:

As described before, the interval from the time when preparations for the fuel supplying operation are started up to the time when the flow quantity pulse signal is first detected, is considered as the state before the fuel supplying operation is started. When the mode setting switch 21 is manipulated in this state, it is discriminated that the fuel supplying apparatus is set to the preset quantity supplying mode for supplying a preset quantity P. Every time the mode setting switch 21 is manipulated (pushed), the lamp which is turned ON, among the indicator lamps 22*d* of the indicator unit 22, successively changes.

This operation will now be described in conjunction with the flow charts. The preparations for starting the fuel supplying operation are made in a stage ST1 shown in FIG. 4. The stage ST1 is made up of steps SP1 through SP7 shown in FIG. 5A, and performs operations such as the lowering of the fuel supplying nozzle 14. When the elevator switch 20 is manipulated in the step SP1, an elevator motor (not shown) within the delivery unit 13 is rotated in a direction so as to lower the fuel supplying nozzle 14 in the step SP2. Accordingly, the fuel supplying nozzle 14 is lowered to the fuel supplying position B. When the step SP3 detects that the fuel supplying nozzle 14 has reached the fuel supplying position B, the step SP4 stops the rotation of the elevator motor. Next, the pump driving motor 16 is rotated in the step SP5, and the indicator unit 22 is reset in the step SP6. A full flag FLG1 is set to 1 and the preset quantity P is initialized (set to zero) in the step SP7. The full flag FLG1 and the preset quantity P are stored in a predetermined area of the data memory 33.

Next, a step S1 shown in FIG. 4 discriminates whether the mode setting switch 21 is ON. When the discrimination result in the step S1 is YES, a preset process is performed in a stage ST2. The stage ST2 is made up of steps SP11 through SP18 shown in FIG. 5B. The step SP11 adds 10 liters to the preset quantity P, and the step SP12 discriminates whether the added quantity is equal to 60 liters. When the added quantity is less than 60 liters, the steps SP13 through SP15 are performed so as to clear the full flag FLG1, preset the quantity P (liters), and turn ON an indicator lamp which corresponds to the preset quantity P among the indicator lamps 22*d*. On the other hand, in the present embodiment, the lamp indicating FULL is designed to turn ON subsequent to the lamp indicating 50 liters, among the indicator lamps 22*d* shown in FIG. 1. For this reason, when the preset quantity P is discriminated as being equal to 60 liters in the step SP12, it is assumed that the fuel is to be supplied until the tank of the vehicle is full, and the steps SP16 through SP18 are performed. The steps SP16 through SP18 sets the full flag FLG1 to 1, initializes the preset quantity P, and turns ON the indicator lamp indicating FULL among the indicator lamps 22*d*. The operation advances to a step S2 shown in FIG. 4 after the step SP18.

The step S2 discriminates whether the flow quantity pulse signal is generated. When the discrimination result in the step S2 is NO, the operation returns to the step S1, and the loop constituted by the step S1, the stage ST2, and the step S2 is repeatedly performed until the operator opens the valve of the fuel supplying nozzle 14 and the flow quantity pulse signal is generated. In this state, the preset quantity P is increased in steps of 10 liters every time the mode setting switch 21 is manipulated. When the flow quantity pulse signal is detected and the discrimination result in the step S2 becomes YES, the operation advances to a step S3 so as to perform the operations related to supply of fuel.

(2) When the fuel supplying apparatus is in the state during the fuel supplying operation:

As described before, the interval from the time when the first flow quantity pulse signal is generated up to the time when the flow quantity pulse signal is no longer generated, is considered as the state during the fuel supplying operation. When the mode setting switch 21 is manipulated in this state, it is discriminated that the fuel supplying apparatus is set to the integral quantity supplying mode.

The step S3 shown in FIG. 4 discriminates whether the full flag FLG1 is equal to zero. When the full flag FLG1 is equal to 1, the discrimination result in the step S3 is NO, and a stage ST3 is performed so as to supply the fuel until the tank of the vehicle becomes full. In the stage ST3, the microprocessor 30 calculates the quantity of supplied fuel and the price of supplied fuel based on the flow quantity pulse signal and the unit price of fuel, and displays the calculated values on the indicators 22*a* and 22*b*. The fill-up operation, in which the fuel is supplied until the tank becomes full, is continued, and a step S4 discriminates whether the mode setting switch 21 is manipulated during this fuel supplying operation. When the discrimination result in the step S4 is NO, a step S5 discriminates whether the flow quantity pulse signal is generated. The operation returns to the stage ST3 when the discrimination result in the step S5 is YES, and the fill-up operation is continued until the tank becomes full and the flow quantity pulse signal is no longer generated, or until the operator closes the valve of the fuel supplying nozzle 14 and the flow quantity pulse signal is no longer generated. When the mode setting switch 21 is manipulated during this full-up operation, the discrimination result in the step S4 becomes YES, and the operation advances to a stage ST5 which will be described later on in the specification so as to perform the operation related to the supply of an integral quantity of fuel.

On the other hand, when the full flag FLG1 is equal to zero, the discrimination result in the step S3 becomes YES, and a preset quantity supplying operation is performed in a stage ST4. The stage ST4 is made up of steps SP21 through SP36 shown in FIG. 6, and performs the preset quantity supplying operation with respect to the quantity which is preset by the preset process in the state (1) described before. When the mode setting switch 21 is manipulated during the preset quantity supplying operation, the operation advances to the stage ST5 which will be described later on in the specification, so as to perform the operation related to the supply of an integral quantity of fuel.

In the stage ST4, the step SP21 displays the quantity of supplied fuel on the indicator 22*a*, and the step SP22 displays the price of supplied fuel on the indicator 22*b*. The step SP23 calculates a remaining quantity $\epsilon$ by subtracting the quantity of supplied fuel from the preset quantity P. The step SP24 discriminates whether the mode setting switch 21 is manipulated. When the discrimination result in the step SP24 is NO, the following steps are performed so as to control the remaining quantity $\epsilon$ to zero. In other words, the step SP25 discriminates whether the remaining quantity $\epsilon$ is less than 0.20 liters, and the operation returns to the step SP21 when the discrimination result in the step SP25 is NO. On the other hand, when the discrimination result in the step SP25 is YES, the operation advances to the step SP26 so as to once stop the supply of current to the pump driving motor 16. The steps SP27 and SP28 respectively display the quantity of supplied fuel and the price of supplied fuel, including an oversupply quantity which is supplied until the pump 17 stops operating. The step SP29 discriminates whether the flow quantity pulse signal exists. When the supply of fuel stops and the flow quantity pulse signal is no longer generated, the discrimination result in the step SP29 becomes NO, and the step SP30 calculates the remaining quantity $\epsilon$.

The step SP31 discriminates whether the calculated value of the remaining quantity $\epsilon$ is less than or equal to 0.00. When the calculated remaining quantity $\epsilon$ is a positive value, the discrimination result in the step SP31 is NO, and the operation advances to the step SP32 wherein a minimum driving time $\Delta t(=f(\epsilon))$ which is pre-stored in correspondence with this value of $\epsilon$ is read out from the data memory 33. The step SP33 rotates the pump driving motor 16 during the time $\Delta t$, and the step SP34 displays the quantity of fuel supplied during this time, and the step SP35 displays the price of fuel supplied during this time.

The step SP36 sets a time $\Delta t$ in accordance with the remaining quantity $\epsilon$, and discriminates whether this time $\Delta t$ has elapsed. The operation returns to the step SP34 until the time $\Delta t$ elapses and the discrimination result in the step SP36 becomes YES. Until the discrimination result in the step SP36 becomes YES, the motor 16 is rotated, and the supply of fuel in terms of the small quantity is repeated so as to gradually make the quantity of supplied fuel closer to the preset quantity P. When the time $\Delta t$ elapses and the discrimination result in the step SP36 becomes YES, the operation advances to the step SP26, and the motor 16 is stopped. Further, the steps SP27 through SP30 are performed, and the operation reaches the step SP31. In this state, the supply of fuel corresponding to the preset quantity P is completed, and the discrimination result in the step SP31 becomes YES. Thus, the operation advances to a step S6 shown in FIG. 4 as indicated by Ⓑ.

When the mode setting switch 21 is manipulated (turned ON) during the fuel supplying operation described above, the following fuel supply of an integral quantity is performed. When it is detected that the mode setting switch 21 is turned ON in the step S4 shown in FIG. 4 or in the stage ST4, the discrimination result in the step S4 becomes YES or the discrimination result in the step SP24 shown in FIG. 6 becomes YES, and the operation advances to the stage ST5 shown in FIG. 4 as indicated by Ⓐ so as to perform the operation of supplying an integral quantity of fuel. The stage ST5 is made up of steps SP41 through SP58 shown in FIG. 7, and supplies fuel until the supplied quantity reaches an integral quantity after the mode setting switch 21 is manipulated.

Figure 7:
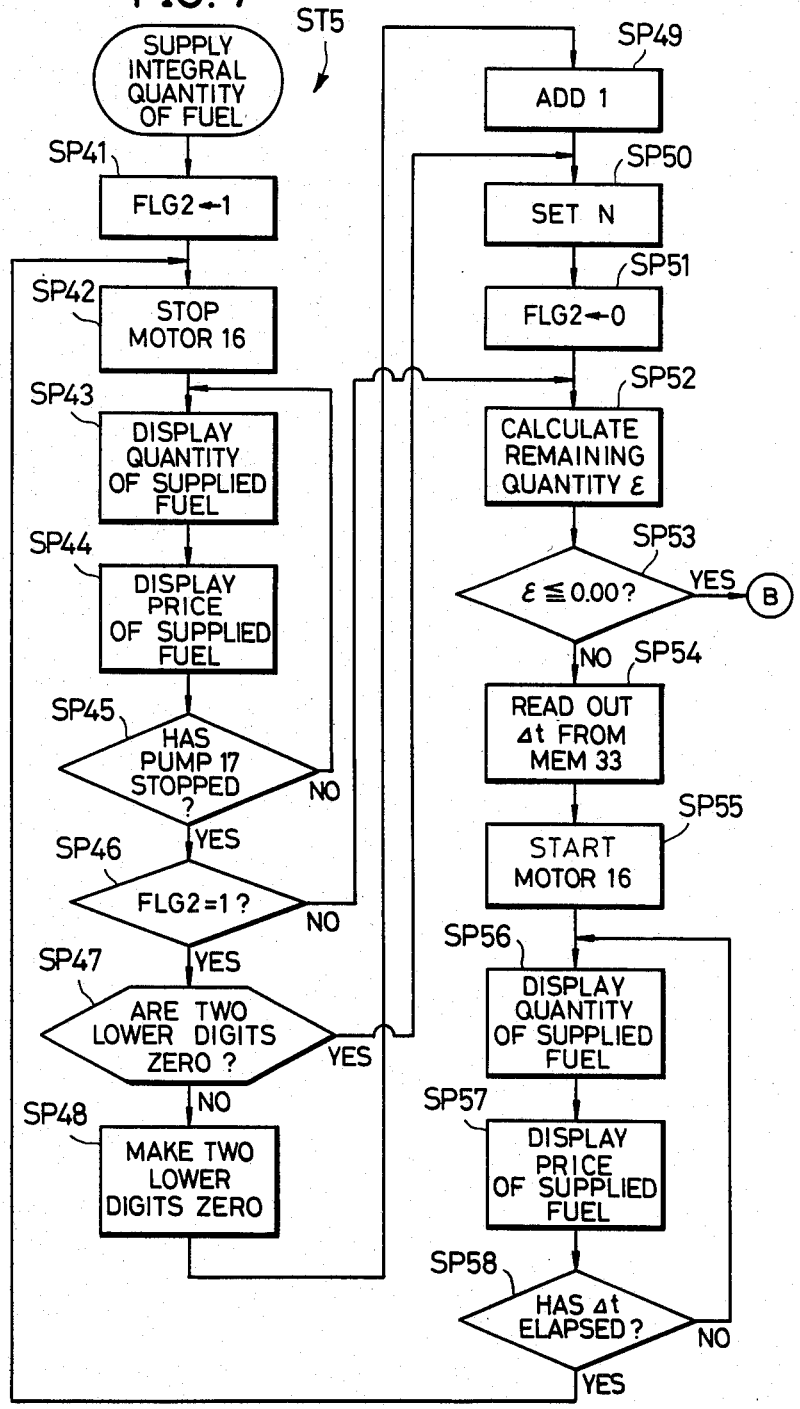

The step SP41 shown in FIG. 7 sets an integral stop flag FLG2 to 1. The step SP42 once stops the supply of current to the pump driving motor 16. The steps SP43 and SP44 respectively display the quantity of supplied fuel and the price of supplied fuel, until the step SP45 discriminates that the pump 17 has stopped completely. When the step SP45 discriminates that the pump 17 has stopped, the step SP46 discriminates whether the integral stop flag FLG2 is equal to 1. When the discrimination result in the step SP46 is YES, an integral quantity N which is closest to the present quantity of supplied fuel, is calculated in the steps SP47 through SP50. In other words, the step SP47 discriminates whether the two lower digits (digits after the decimal point) of the quantity of supplied fuel are equal to zero. When the discrimination result in the step SP47 is NO, the step SP48 makes the two lower digits zero. The step SP49 adds an integer "1" to the value having the two lower digits which were made zero in the step SP48. The step SP50 sets the value obtained from the step SP49 as the integral quantity (target quantity) N. The step SP51 clears the integral stop flag FLG2 to zero. When the new target fuel supplying quantity N is determined in this manner, similar processes are performed in the steps SP52 through SP58 and the steps SP42 through SP44 shown in FIG. 7, and the steps SP30 through SP36 and the steps SP26 through SP28 shown in FIG. 6. As a result, the integral quantity N of fuel is supplied. When the step SP53 discriminates that the remaining quantity $\epsilon$ is less than or equal to zero, the operation advances to a step S6 shown in FIG. 4 as indicated by Ⓑ.

(3) When the fuel supplying apparatus is in the state after the fuel supplying operation is terminated:

As described before, the interval from the time when the flow quantity pulse signal is no longer generated up to the time when the fuel supplying nozzle 14 is returned to the waiting position A, is considered as the state after the fuel supplying operation is terminated. When the mode setting switch 21 is manipulated in this state, it is discriminated that the fuel supplying apparatus is set to the additional integral quantity supplying mode. An additional integral quantity K is preset as follows. That is, the digits after the decimal point in the value indicating the quantity of supplied fuel up to the time when the fuel supply is once stopped, are made equal to zero, and an integer M is then added to this value so as to obtain a predetermined integral value. The additional integral quantity K is preset to this predetermined integral value. The integer M is dependent on the number of times the mode setting switch 21 is manipulated.

When the flow quantity pulse signal is no longer detected in the step S5 shown in FIG. 4, the microprocessor 30 initializes the value M to zero and sets a flag FLG3 to 1 in a step S6. A step S7 discriminates whether the mode setting switch 21 is manipulated (turned ON). When the discrimination result in the step S7 is YES, steps S8 through S12 are performed so as to count the number of times M the mode setting switch 21 is turned ON during a predetermined time T. In other words, when the mode setting switch 21 is turned ON, the step S8 adds 1 to the value M, and the step S9 discriminates whether the flag FLG3 is equal to 1. The step S10 sets a timer to the predetermined time T, and the step S11 clears the flag FLG3 to zero. The step S12 discriminates whether the predetermined T has elapsed. The operation returns to the step S7 when the discrimination result in the step S12 is NO. Accordingly, the number M is incremented by one when the mode setting switch 21 is pushed once and is then pushed again within the predetermined time T, and the number M is incremented by a number of times the mode setting switch 21 is successively pushed. When the mode setting switch 21 is no longer pushed and the discrimination result in the step S12 becomes YES, a step S13 makes the lower two digits zero in the value indicating the quantity of supplied fuel. A step S14 obtains the additional integral quantity K by adding the value M to the value which is obtained from the step S13. A step S15 starts the pump driving motor 16 by applying current thereto. The operation then returns to the stage ST4 so as to preset the additional integral quantity K, and to perform the operation of supplying the additional integral quantity of fuel.

On the other hand, when the discrimination result in the step S7 is NO, a step S16 discriminates whether the flow quantity pulse signal is generated. When the discrimination result in the steps S16 is YES, it is discriminated that the operation of additionally supplying fuel is started so as to fill the tank, and the operation returns to the stage ST3. However, when the discrimination result in the step S7 is NO, a step S17 discriminates whether the flag FLG3 is equal to 1. The operation advances to the step S12 when the flag FLG3 is equal to zero, but a step S18 discriminates whether the elevator switch 20 is manipulated when the flag FLG3 is equal to 1. When the discrimination result in the step S18 is NO, the operation returns to the step S7. On the other hand, when the discrimination result in the step S18 is YES, the operation advances to a stage ST6 wherein processes are performed to terminate the fuel supplying operation. In the stage ST6, the pump driving motor 16 is stopped, and the fuel supplying nozzle 14 is returned to the waiting position A so as to terminate one fuel supplying operation.

The advantageous effects of the present embodiment are especially notable when applied to the hanging type fuel supplying apparatus described heretofore. However, the present embodiment is not limited to this application, and for example, the present embodiment may be applied to a ground type (fixed type) fuel supplying apparatus having the fuel measuring device fixed on the ground. In the embodiment described heretofore, the fuel is measured in liters, however, the fuel may be measured in other units such as gallons.

Further, the present invention is not limited to these embodiments, but various variations and modifications may be made without departing from the scope of the present invention.

What is claimed is:

1. A fuel supplying apparatus comprising:

(a) a fuel supplying hose having a fuel supplying nozzle provided on a tip end thereof (b) a pump for supplying fuel to said fuel supplying hose (c) driving means for driving said pump (d) measuring means for measuring a flow quantity of the fuel which is supplied through said fuel supplying hose (e) a mode setting switch provided on said fuel supplying hose at a position in a vicinity of said fuel supplying nozzle (f) discriminating means coupled to said measuring means and said mode setting switch for discriminating whether the fuel supplying apparatus is in a state before a fuel supplying operation is started or in a state during the fuel supplying operation in response to an output of said measuring means, and for setting the fuel supplying apparatus in a preset quantity supplying mode when said mode setting switch is manipulated in the state before the fuel supplying operation is started and setting the fuel supplying apparatus in an integral quantity supplying mode when said mode setting switch is manipulated in the state during the fuel supplying operation, said discriminating means producing an output indicating the mode of the fuel supplying apparatus; and (g) control means coupled to said discriminating means for controlling said driving means in response to the output of said discriminating means so that a preset quantity fuel supplying operation is performed to supply a fuel supplying quantity which is preset in response to a manipulation of said mode setting switch when the output of said discriminating means indicates the preset quantity supplying mode and an integral quantity fuel supplying operation is performed to supply a minimum integral fuel supplying quantity when the output of said discriminating means indicates the integral quantity supplying mode, said minimum integral fuel supplying quantity being greater than a quantity of supplied fuel at a time when said mode setting switch is manipulated.

2. A fuel supplying apparatus as defined in claim 1, wherein said discriminating means also discriminates whether the fuel supplying apparatus is in a state after the fuel supplying operation is terminated in response to the output of said measuring means and sets the fuel supplying apparatus in an additional integral quantity supplying mode when said mode setting switch is manipulated in the state after the fuel supplying operation is terminated, and said control means also controls said driving means in response to the output of said discriminating means so that an additional quantity fuel supplying operation is performed with an additional integral fuel supplying quantity which is preset in response to a manipulation of said mode setting switch when the output of said discriminating means indicates the additional integral quantity fuel supplying mode.

3. A fuel supplying apparatus as defined in claim 1, further comprising a delivery unit, an elevator mechanism within said delivery unit for raising and lowering said fuel supplying hose and said fuel supplying nozzle, and an elevator switch for operating said elevator mechanism, said mode setting switch and said elevator switch being respectively provided on said fuel supplying hose at positions in the vicinity of said fuel supplying nozzle.

4. A fuel supplying apparatus as defined in claim 1, wherein said control means comprises memory means for pre-storing a plurality of pre-established fuel supplying quantities, said control means selectively reading out one of said pre-established fuel supplying quantities from said memory means and presetting the read-out pre-established fuel supplying quantity as a desired fuel supplying quantity every time said mode setting switch is manipulated when the output of said discriminating means indicates the preset quantity supplying mode.

5. A fuel supplying apparatus as defined in claim 1, wherein said control means comprises integral quantity obtaining means for obtaining said minimum integral fuel supplying quantity by setting the digits after a decimal point of a fuel supplying quantity equal to zero at a time when said mode setting switch is manipulated and adding unity when the output of said discriminating means indicates the integral quantity supplying mode, said control means operating said driving means to drive said driving means until a quantity of supplied fuel reaches said minimum integral fuel supplying quantity.

6. A fuel supplying apparatus as defined in claim 4, wherein said control means comprises additional integral quantity obtaining means for obtaining said additional integral fuel supplying quantity by setting to zero digits after a decimal point of a fuel supplying quantity at a time when an initial fuel supplying operation is terminated and adding a value corresponding to a number of times said mode setting switch is manipulated when the output of said discriminating means indicates the additional integral quantity supplying mode, said control means operating said driving means to drive said driving means until a quantity of supplied fuel reaches said additional integral fuel supplying quantity.

* * * * *